US009488018B2

(12) United States Patent
Linklater et al.

(10) Patent No.: US 9,488,018 B2
(45) Date of Patent: Nov. 8, 2016

(54) FLUID DISPLACEMENT TOOL AND METHOD

(71) Applicant: M-I Drilling Fluids U.K. Limited, Aberdeen (GB)

(72) Inventors: James Linklater, Buckie (GB); Mark Temple, Kirkton of Logie Buchan (GB)

(73) Assignee: M-I DRILLING FLUIDS UK LTD, Aberdeen (GB)

( * ) Notice: Subject to any disclaimer, the term of this patent is extended or adjusted under 35 U.S.C. 154(b) by 0 days.

(21) Appl. No.: 14/404,028

(22) PCT Filed: May 30, 2013

(86) PCT No.: PCT/US2013/043396

§ 371 (c)(1),
(2) Date: Nov. 26, 2014

(87) PCT Pub. No.: WO2013/181413

PCT Pub. Date: Dec. 5, 2013

(65) Prior Publication Data

US 2015/0233196 A1 Aug. 20, 2015

(30) Foreign Application Priority Data

May 30, 2012 (GB) ..... 1209598.0

(51) Int. Cl.
*E21B 21/00* (2006.01)
*E21B 33/08* (2006.01)
(Continued)

(52) U.S. Cl.
CPC ..... *E21B 21/001* (2013.01); *E21B 17/01* (2013.01); *E21B 33/08* (2013.01); *E21B 33/12* (2013.01)

(58) Field of Classification Search
CPC ..... E21B 21/001; E21B 17/01; E21B 21/00; E21B 37/00; E21B 37/10; E21B 43/121; E21B 33/08; E21B 33/12
USPC ..... 166/173, 177.3
See application file for complete search history.

(56) References Cited

U.S. PATENT DOCUMENTS 1,495,807 A * 5/1924 Sanders ..... 417/552
3,996,839 A 12/1976 Norwood
(Continued)

FOREIGN PATENT DOCUMENTS

WO 2007032687 A1 3/2007

OTHER PUBLICATIONS

International Search Report for corresponding PCT Application No. PCT/US2013/043396, dated Sep. 4, 2013, 5 pages.
(Continued)

*Primary Examiner* — James G Sayre
(74) *Attorney, Agent, or Firm* — David J. Smith

(57) ABSTRACT

A riser displacement and cleaning tool assembly (10) comprises a running tool (8) attachable to a work string (11), and a fluid displacing body (1) supported upon the running tool. The fluid displacing body has a head portion (6) provided with an opening (12) to accommodate relative movement of the fluid displacing body with respect to the work string, and also has flexible wiper elements (2) providing dynamic sealing contact with adjacent surfaces of the work string and a riser (20). The fluid displacing body has a skirt (5) depending from the head portion and enclosing a chamber (7) for receiving a fluid. The fluid displacing body is adapted to sealingly engage the riser and the string and is selectively releasable from an initial configuration where the fluid displacing body is supported by the running tool to an operational configuration where the fluid displacing body is axially displaceable from the running tool by introduction of a fluid to the chamber.

9 Claims, 2 Drawing Sheets

(51) Int. Cl.
*E21B 33/12* (2006.01)
*E21B 17/01* (2006.01)

(56) References Cited

U.S. PATENT DOCUMENTS

| | | | | |
|---|---|---|---|---|
| 5,012,866 | A * | 5/1991 | Skipper | 166/170 |
| 7,389,818 | B2 * | 6/2008 | Hoiland | 166/367 |
| 7,624,806 | B2 * | 12/2009 | Booth | 166/311 |
| 2003/0000704 | A1 * | 1/2003 | Reynolds | 166/312 |
| 2005/0252657 | A1 | 11/2005 | Tocalino et al. | |
| 2006/0225888 | A1 * | 10/2006 | Reitz | 166/370 |
| 2008/0185150 | A1 * | 8/2008 | Brown | 166/311 |
| 2008/0245528 | A1 * | 10/2008 | Stokka et al. | 166/357 |

OTHER PUBLICATIONS

Examination Report issued in GB1421547.9 on May 5, 2015, 1 page.
Examination Report issued in GB1421547.9 on Sep. 2, 2015, 2 pages.

* cited by examiner

FLUID DISPLACEMENT TOOL AND METHOD

This application claims priority as a U.S. National Stage Application of Patent Cooperation Treat (PCT) of PCT/US2013/043396, filed May 30, 2013, which claims priority to Great Britain Patent Application No. 1209598.2, filed May 30, 2012. The disclosure of each of the priority applications are incorporated by reference herein in its entirety.

TECHNICAL FIELD

This disclosure relates to the field of oil and gas reservoir exploitation, and discloses a tool designed to inhibit co-mingling of fluids of different densities during fluid displacement operations.

BACKGROUND

In offshore petroleum production, drilling vessels are used on the sea surface to drill wells in the seabed. A wellhead is installed on the seabed and is sealingly connected to the well casing and provided with the necessary control and contingency structures including a valve assembly (BOP) and connecting devices to a riser which connects the wellhead to the drilling vessel at the sea surface. The riser is used in connection with the return and circulation of drilling fluids from the well and is normally filled with drilling fluid in the drilling phase which both lubricates the bit and allows return of cuttings in the circulating fluid. The riser is in addition equipped with longitudinal, externally located smaller pipes (choke, kill and optionally booster line) which are connected to a valve manifold on the drilling vessel. These pipes are used, inter alia, in connection with the replacement of fluid in the riser and for adding more drilling fluid in the well to improve well control if the well pressure rises by an intolerable amount whereupon it may be necessary to close the valve assembly (BOP) that is connected sealingly to the wellhead underneath and the riser above in order to prevent undesirable outflow of drilling and well fluids.

In order to commence drilling a drill string is lowered into the riser, which string may consist of sections of pipe and which at its lower end has a bottom hole assembly including drill collars and a drill bit. There are various ways of driving the bit known in the art for example using a top drive motor on the drilling derrick but typically the circulating drilling fluid may be used with a borehole ("mud" or Moineau) motor to drive the bit taking account of the length of string necessary to reach the required greater depths of current wells.

During deep water drilling and production operations, there may arise circumstances where it becomes necessary to disconnect the marine riser from the wellhead. Those in the field will understand the difficulties of effecting a safe and environmentally sound disconnect of the riser in view of the need to displace drilling fluids or completion fluids as a preliminary step in such a riser disconnect. In particular the operation to displace the drilling or completion fluid to seawater requires a careful and methodical approach yet in practice the time available may be limited to complete such an operation e.g. due to an approaching storm.

In an emergency shut-down and disconnect, the riser may be suspended open-ended which could have an environmental impact if well fluids or working fluids leak from the open end of the riser. Consideration has to be given to clearing the riser of drilling or completion fluids etc. without causing adverse environmental consequences, without loss of the expensive fluids into the environment, and allowing, when necessary, subsequent safe topside dismantling of the riser components without contaminating the deck or drill floor. If spillage of drilling fluids takes place during subsea unlatching of the riser or in a subsequent riser pull out and lay down operation, then it is necessary to follow this with a clean up operation which is both expensive and time-consuming. If the rig had to be secured rapidly due to an approaching storm, then for safety reasons a clean up would not be possible until after the storm passes, in which event the clean up operation would also delay re-start of normal operations.

Current practice would be to pump the displacement fluid via lines in the well head (kill, choke or booster lines normally present in the wellhead structure for other purposes can be utilised) to displace the riser fluid upwards to surface for recovery and storage.

A drilling fluid is typically of an inverse emulsion character where the continuous (external) phase is oil-based and the discontinuous (internal) or dispersed phase is aqueous-based. Special purpose surface active additives stabilise the fluid for use so that it retains its intended design characteristics and properties. Other fluids used within the riser include completion fluids which have a different chemical composition, typically being brines such as chlorides, bromides and formates. Such a drilling or completion fluid will be referred to hereinafter as a "riser fluid" for ease of discussion in the context of this disclosure. The displacement fluid may be any environmentally benign fluid such as seawater or brine or an equivalent.

Typically, during displacement of the riser fluid prior to disconnect, the introduced displacement fluid, e.g. seawater, meets the riser fluid at an interface which in practice is not clearly defined, and a fair amount of mingling of the dissimilar fluids (perhaps 10% or more of the riser volume) takes place during the riser displacement operation. As a consequence, operators have been faced with recovering the fluids and confronting the reality that a fair proportion of the riser fluid will be contaminated with seawater. From another standpoint inevitably a volume of seawater is captured with riser fluid contamination and this cannot be discharged overboard, and must be processed. Either way, an operator has to process a significant volume of fluids which may be separated but only after input of energy and resources. This may entail storing the mingled fluids or partially separated fluids for shipment to a shore installation for final processing treatment. This problem is particularly acute at deep water sites where the riser volume may be as much as 2,000 barrels of fluid or more.

In the past, attempts to address the mingling problem have included introduction of a plug or pill of a gelled viscous material that is insoluble or immiscible in the respective fluids to act as a physical barrier to mingling.

European patent number EP 1 937 930 describes a method and device for preventing mixing of fluids in a riser.

DESCRIPTION OF EMBODIMENTS

Figure 1:
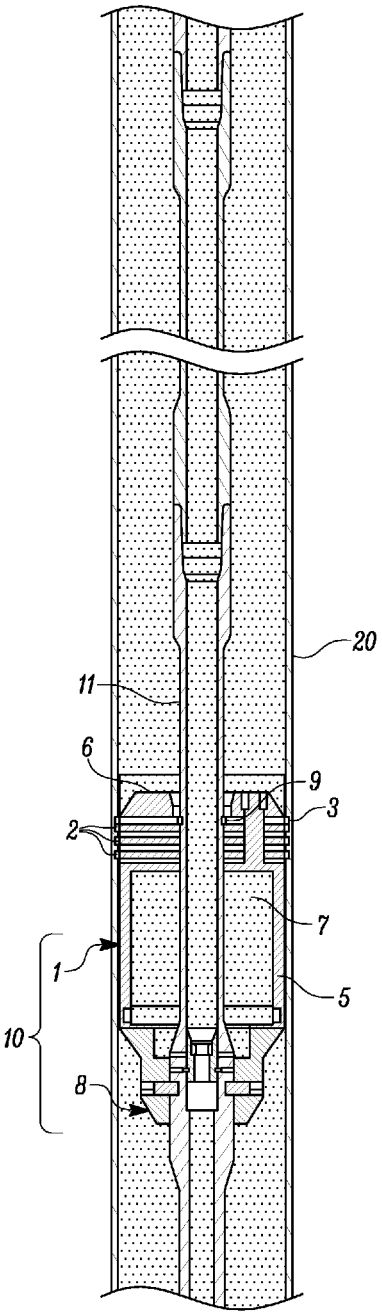
FIG. 1 is a longitudinal section through a shrouded riser displacement and cleaning body supported on a running tool mounted on a work string.
Figure 2:
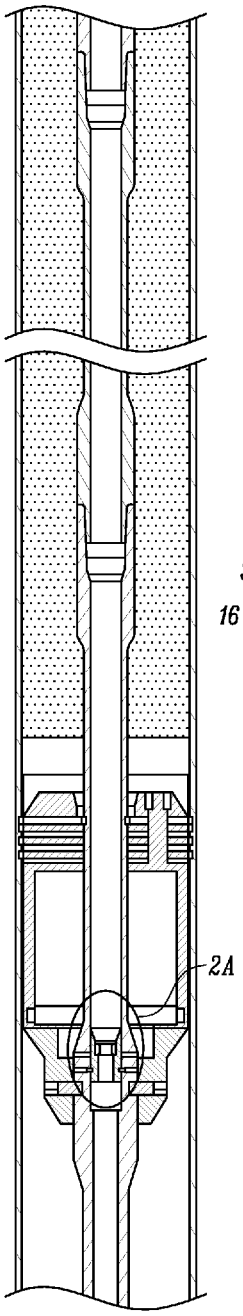
FIG. 2 is a longitudinal section through a shrouded riser displacement and cleaning body supported on a running tool mounted on a work string during initial displacement of riser fluid to above the body by introducing displacement fluid below the body.
Figure 2A:
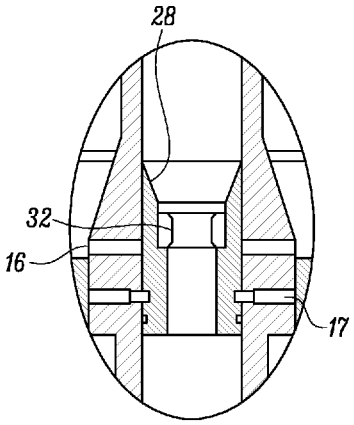
FIG. 2*a* shows detail of a flow restrictor receiving seat within a displaceable internal sleeve positioned within the bore above the running tool in its open bore position.
Figure 3:
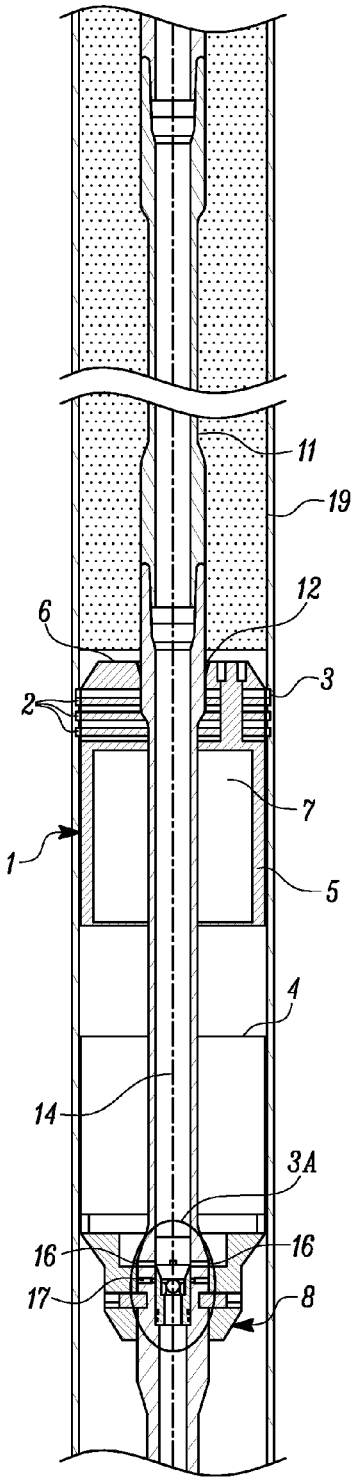
FIG. 3 is a longitudinal section through a riser displacement and cleaning body axially displaced from the shroud and running tool after delivery of a plug to actuate a flow configuration change near the running tool to divert downcoming displacement fluid under the riser displacement and cleaning body.
Figure 3A:
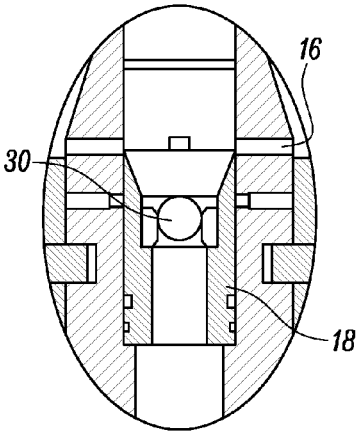
FIG. 3*a* shows detail of the seated plug and displaced internal sleeve within the running tool.
Figure 4:
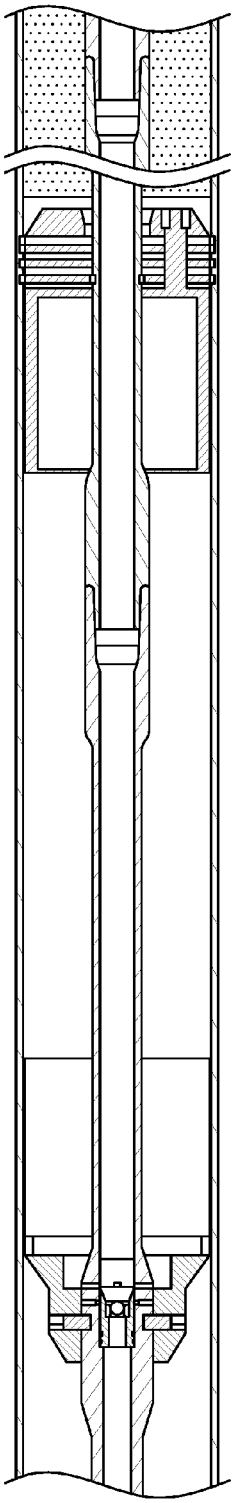
FIG. 4 is a longitudinal section through a riser displacement and cleaning body as it is pumped upwardly through the riser displacing riser fluid ahead of it.

Considering FIG. 1, a riser displacement and cleaning tool assembly 10 configured for introduction through a riser 20 comprises a running tool 8 attached to a work string 11 made up of lengths of drill pipe connectable using standard tool joints. The work string may incorporate other tools, subs and instruments. In embodiments where the work string 11 has a bottom assembly (BHA) fitted for removing formation material, for example for extending a wellbore by drilling, the work string would be commonly referred to as a drill string.

A generally tubular fluid displacing body 1 may be shaped like a piston having a head portion 6 for displacing fluid. The head portion 6 provides a mounting surface for a series (four illustrated) of dynamic riser seals extending laterally from the head portion 6. The dynamic riser seals can be formed from flexible wiper elements 2, which in use contact the riser inner surface 19 sufficiently to inhibit fluid leakage past these seals, and also contact the work string 11 sufficiently to inhibit fluid leakage past these seals. The wiper elements 2 may be formed from oversize flexible discs with respect to the transverse dimensions of the head portion 6 and riser 20. By such sizing of the flexible discs, the peripheral edges of the discs flex and are urged into sealing contact with the adjacent surface of riser or string respectively by resilience of the disc material. The outer edges 3 of the wiper elements 2 may be protected during introduction through the riser 20 by an open ended shroud ("can") 4.

The piston-shaped fluid displacing body 1 has a crown in which a central opening 12 is provided for accommodating the work string 11 and allowing relative movement of the fluid displacing body 1 with respect thereto. The disc shaped wiper elements 2 have inner resilient edges 9 forming dynamic seals against the string allowing when required relative movement between the fluid displacing body 1 and the work string 11 whilst resisting fluid leakage or by-pass from above the head portion 6 of the fluid displacing body 1 to below the head portion 6.

The fluid displacing body 1 has a skirt 5 depending from the head portion 6 and enclosing a chamber 7. The lower extent of the chamber 7 is bounded by the running tool 8.

The running tool 8 includes lateral flow channels 16, and incorporates a releasable sleeve 18, assembled with the running tool 8 by use of sacrificial fasteners in the form of shear pins 17, so as to be held in an initial position occluding the lateral fluid flow channels 16 for the purposes of introduction of the tool assembly 10 into the riser. The sleeve 18 allows through connection between the throughbore 14 of the work string 11 above and below the tool assembly 10. The sleeve 18 has a tapered inlet 28 to a ball seat 32 which adapted to receive a plug such as a drop ball 30 or a dart for a purpose to be more particularly described hereinbelow.

The piston-shaped fluid displacing body 1 is supported within a protective shroud 4 or "can" upon a running tool 8 attached into a work string 11 for introduction into the riser 20. The fluid displacing body 1 is displaceable upwardly away from the running tool 8 and protective shroud 4 or "can" by delivery of a displacement fluid below the fluid displacing body 1. The arrangement is such that the fluid displacing body 1 travels over the string and is never isolated from it. This means that recovery of the string inevitably recovers the fluid displacing body 1 if it has not already been pumped to surface with the final volume of displaced riser fluid.

Displacement of riser and well bore fluids is achievable in an industry recognised procedure by pumping down the string a benign displacement fluid such as seawater, augmented if necessary by additional amounts delivered via kill, choke or booster lines in the well head to displace the riser fluid upwards to surface for recovery and storage.

In use, the tool assembly 10 as disclosed herein is run into the well riser 20 to the required depth. A suitable light displacement fluid e.g. seawater, is pumped down the work string 11 until it returns up the annulus between the riser 20 and the string 11, to reach the underside of the tool assembly 10, whereupon at least some of the lighter displacement fluid will seek a way around the obstructing tool assembly, by-passing the outside of the protective shroud (can) 4. At this stage heavy riser fluid to be displaced is above the tool assembly 10. In order to effect positive displacement of the heavy riser fluid it is necessary to introduce sufficient displacement fluid beneath the displaceable piston body 1 to pump it upwardly out of the shroud 4 away from the supporting running tool 8 which remains at the deployed depth. A drop ball 30 is introduced to the bore 14 of the string 11 and captured upon the seat 32 which means that through passage of displacement fluid into the throughbore of the work string below the tool assembly 10 is obstructed. By increasing pumping effort sufficiently, an increased fluid pressure upon the ball seat combination exceeds the yield point of the shear pins 17 whereupon the sleeve 18 is forced axially downwards exposing lateral flow channels 16 in the running tool which are thereby opened to the downcoming displacement fluid from the throughbore 14 of the work string 11. These opened channels feed the displacement fluid directly into the chamber 7 within the skirt 5 enabling displacement of the fluid displacing body 1 upwardly. This in turn effects displacement of the riser fluid ahead of the fluid displacing body 1 to surface. The dynamic seal elements 3, 9 contact both the inner surface 19 of the riser and the work string 11 on the way to the surface and inhibit leak past of heavy riser fluid.

Continued pumping of the displacement fluid which may be seawater then pumps the fluid displacing body 1 up the riser displacing riser fluid on the way up. In this way the riser is cleared of riser fluids which are replaced by seawater, permitting the riser to be disconnected at the well head without the usual risks of spillage of environmentally harmful amounts of riser or well fluids through the open end of the suspended riser. If it is necessary to pull the riser to the vessel, then break up and lay-down operations on the drill deck are facilitated due to reduced contamination risks. Riser re-deployment for resumption of normal operation can be initiated sooner in the absence of a need to conduct clean up operations.

Should it be necessary as a contingency measure to recover the tool before complete pumping of the fluid displacing body to surface as discussed above, it is possible to pull the work string 11 out of the riser 20 and as it is lifted, the running tool 8 will once again capture the fluid displacing body 1 and retrieve it to surface.

SUMMARY OF THE DISCLOSURE

An approach to addressing the mingling problem proposed in this disclosure is to minimise the mingling of fluids by using a riser displacement method and fluid displacement tool which inhibits such mingling of fluids and facilitates a cleaner riser displacement and disconnect procedure to be realised.

In this approach a riser displacement and cleaning tool (RDCT) is positioned in the lower part of the riser to serve as a physical barrier to mingling of fluids i.e. the riser fluid is above the tool and the displacement seawater or brine is introduced below the tool. The tool is therefore configurable to sealingly engage the riser and the string and is selectively releasable from a run-in configuration where the tool is supported by a running tool to an operational configuration where the tool is axially displaceable from the running tool.

The change in configuration may be realised by passing a flow restricting plug, such as a ball, dart or the like obturating device through the fluid to come to rest on a stop shoulder or seat associated with the running tool and thereby effect sufficient fluid flow restriction as to allow a build-up of pressure to be achieved which is adequate to develop force to effect a configuration change in the tool assembly. This force may be sufficient to cause retaining means holding a sleeve component of the running tool in the run-in configuration to yield and release the retained parts to permit the configuration change by relative movement of component parts. The retaining means may comprise shear pins or the like sacrificial fasteners.

According to an aspect of this disclosure, the fluid displacement tool comprises a fluid displacing body adapted to be releasably attached to a string, the fluid displacing body having a throughbore enabling the body to be moveable axially over the string whilst remaining associated with the string, wherein at least one internal seal is provided on the body within the throughbore to sealingly engage with the string thereby to inhibit fluid passage therebetween as the fluid displacing body is moved relative to the string, and at least one further seal is provided on the exterior of the body to sealingly engage with a riser internal surface thereby to inhibit fluid passage therebetween as the fluid displacing body is moved relative to the riser. The respective internal and external seals may be optionally referred to as respectively string seal(s) and riser seal(s).

The riser displacement and cleaning tool may use one, or more typically a series of wiper cleaning elements as dynamic seal elements which seal outwardly against and wipe clean the inside of the riser displacement proceeds. Multiple flexible wiper elements may be provided in close axial spacing upon the body and extend laterally from the body sufficiently to seal upon adjacent riser surface.

Similarly, flexible wiper elements may also serve as internal seals suitable for use in the fluid displacement tool for sealingly engaging the string. Such internal sealing elements may extend inwardly to the string for sealing thereupon.

The body of the tool takes the form of a hollow piston where the crown of the piston has an aperture for accommodating the string and allowing relative movement with respect thereto. The piston has a head providing a mounting for the riser and string dynamic seals, and a skirt extending downwardly around the string to define an open bottomed chamber.

The body of the tool may be adapted to be supported by a running tool, and may be run within a protective shroud or "can". In use the tool may be actuated to change from the protected "run-in" configuration attached to the running tool to an operational configuration wherein the body can be displaced from the running tool by ingress of fluid pressure, such that the body is moved upwardly from within the protective shroud to move axially within the riser. Although displaced from the running tool and protective shroud in operational use, the body can be readily recovered or "recaptured" by the running tool and shroud by simply lifting the string, i.e. pulling the string from the riser will automatically recover the body upon the string when required. Equally, in normal usage the fluid displacing body can be recovered at surface with the last of the riser fluid, same being displaced by the displacement fluid now filling the riser from below the fluid displacing body.

Therefore the tool offers several advantages over prior tools, including positive recovery of the fluid displacing body either by simply pumping riser displacement fluid into the riser below the body, or by pulling the string out of the riser. Furthermore the body being mounted through its throughbore about the string cannot come adrift in normal operational use.

In such normal operational use, the tool is supported upon a running tool attached to a drill string or work string and run in to the required depth in the riser fluid, which may be a dense or heavy fluid commonly referred to as "mud".

In the displacement method, a lighter fluid such as seawater or brine is introduced at the lower end of the riser, and the heavier riser fluid displaced thereby is recovered at the top of the riser.

Consequently when the riser displacement and cleaning tool is to be deployed, it will be typically run in on a tool, optionally with a release mechanism (to effect release from the running tool). The running tool is used to deploy the riser displacement and cleaning tool down through the heavy fluid within the riser, to the region where the riser is connected to the wellhead, e.g. riser flex joint typically into the blow-out preventer stack at the lower end of the riser.

The riser dynamic seal elements are protected on run in through the riser by a releasable protective shroud or sleeve, commonly referred to as a "can". The string dynamic seals are of course static relative to the run in string carrying the tool into the riser and need no special protective measures.

As the lighter displacement fluid is pumped down the string (or additionally via an ancillary conduit such as the kill, choke or booster lines) in the normal way, that lighter displacement fluid will return up the annulus between the string and the riser to contact the underside of the tool.

An activation device, such as a ball, dart or the like plug suitable for restricting flow through the tool, can be released into the bore at the top of the string. The activation device falls or is positively circulated to the tool as appropriate during pumping of the lighter displacement fluid. When the device becomes lodged in the tool it is then possible to increase pump delivery to effect a pressure increase upon the activation device within the tool. The activation device being restrained from further axial displacement within the tool by a seat or shoulder transfers loading to an internal sleeve associated with the running tool. Use of sacrificial fasteners, such as shear pins to hold the sleeve in run-in configuration means that at a predetermined pressure these pins yield to allow the sleeve to be displaced axially and effect a configuration change for the tool thereby actuating the tool. The seating of the activation device (e.g. ball) within the internal bore of the tool connected with the throughbore of the string seals off fluid communication up the string below the tool, but with the axial displacement of the sleeve bearing the seat for the device, fluid communication channels are revealed and accessible to the displacement fluid delivered down the string, whereby additional displacement fluid can be introduced between the tool and the running tool due to the seating of the activation device. This displacement fluid now pushes the tool upwardly over the string away from the running tool and thereby displaces the heavier riser fluid above it.

According to another aspect of this disclosure there is provided a method of displacing riser fluid from a riser e.g. before disconnecting same from a wellhead, comprising the steps of providing a riser displacement and cleaning tool adapted to be incorporated in a work string, the tool being both sealingly movable over the string and sealingly movable within the riser under the influence of fluid pressure from a displacement fluid delivered below the tool to thereby displace riser fluid above the tool whilst inhibiting fluid by-pass around the tool within the riser.

CALL OUTS FOR DRAWINGS USED IN SPECIFIC DESCRIPTION riser displacement cleaning tool assembly 10
"piston"-shaped fluid displacing body 1
head 6
skirt 5
chamber 7
dynamic riser seals 3
flexible wiper elements 2,
dynamic string seals 9
open ended shroud ("can") 4.
work string 11
piston crown central opening 12
throughbore 14
riser 20
riser inner surface 19
running tool 8
releasable sleeve 18,
tapered inlet 28
ball seat 32
shear pins 17,
lateral fluid flow channels 16
drop ball 30

What is claimed is:

1. A fluid displacement tool, comprising:

a fluid displacing body provided inside a riser, the fluid displacing body releasably attached to a work string, the fluid displacing body having a throughbore enabling the fluid displacing body to be moveable axially over the work string whilst remaining associated with the work string, the fluid displacing body further comprising:

at least one internal seal provided on the fluid displacing body within the throughbore to sealingly engage with the work string, thereby inhibiting fluid passage therebetween as the fluid displacing body is moved relative to the work string, and at least one further seal provided on an exterior surface of the fluid displacing body to sealingly engage with an internal surface of the riser, thereby inhibiting fluid passage therebetween as the fluid displacing body is moved relative to the riser;

a running tool attached to the work string, the running tool comprising lateral flow channels; and a releasable sleeve assembled with the running tool using sacrificial fasteners, the releasable sleeve held in a first position occluding the lateral flow channels.

2. The fluid displacement tool as claimed in claim 1, wherein the further seal comprises a series of wiper cleaning elements for sealing outwardly against the riser and for wipe cleaning the internal surface of the riser.

3. The fluid displacement tool as claimed in claim wherein the wiper cleaning elements are provided in close axial spacing upon the fluid displacing body and extend laterally from the fluid displacing body to seal upon the internal surface of the riser.

4. The fluid displacement tool as claimed in claim 1, comprising multiple flexible wiper elements configured to serve as internal seals for engaging the work string.

5. The fluid displacement tool as claimed in claim 1, comprising at least one flexible disc configured to form both an internal seal against the work string and an external seal against the riser.

6. The fluid displacement tool as claimed in claim 1, wherein the fluid displacing body is a hollow piston comprising a head portion, and a skirt portion extending downwardly from the head portion defining an open bottomed chamber.

7. The fluid displacement tool as claimed in claim 6, wherein the head portion comprises an aperture for accommodating the work string and allowing relative movement between the work string and the hollow piston.

8. The fluid displacement tool as claimed in claim 6, wherein the head portion provides a mounting for the riser and the internal seal.

9. A method of displacing riser fluid from a riser, the method comprising the steps of:

sealingly engaging at least one internal seal between a throughbore of a fluid displacing body and a work string;

sealingly engaging at least one further seal between an exterior surface of the fluid displacing body and an internal surface of a riser;

attaching a running tool to the work string, the running tool comprising lateral flow channels;

assembling a releasable sleeve with the running tool using sacrificial fasteners; and holding the releasable sleeve in a first position occluding the lateral flow channels.

* * * * *